US008051818B2

(12) United States Patent
Myers et al.

(10) Patent No.: US 8,051,818 B2
(45) Date of Patent: Nov. 8, 2011

(54) DUAL INDEPENDENT PHASING SYSTEM TO INDEPENDENTLY PHASE THE INTAKE AND EXHAUST CAM LOBES OF A CONCENTRIC CAMSHAFT ARRANGEMENT

(75) Inventors: Jesse Myers, Waterford, MI (US); Joseph Moon, Clawson, MI (US); Roger Meyer, Brighton, MI (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 140 days.

(21) Appl. No.: 12/571,698

(22) Filed: Oct. 1, 2009

(65) Prior Publication Data

US 2010/0093453 A1 Apr. 15, 2010

Related U.S. Application Data

(60) Provisional application No. 61/104,037, filed on Oct. 9, 2008.

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.16, 90.18; 464/1, 2, 160
See application file for complete search history.

(56) References Cited

U.S. PATENT DOCUMENTS

| | | | | |
|---|---|---|---|---|
| 4,858,572 | A * | 8/1989 | Shirai et al. | 123/90.12 |
| 6,805,080 | B2 | 10/2004 | Golovatai-Schmidt et al. | |
| 7,563,986 | B2 * | 7/2009 | Shitamura | 174/254 |
| 7,841,311 | B2 * | 11/2010 | Hutcheson et al. | 123/90.17 |

FOREIGN PATENT DOCUMENTS

| | | |
|---|---|---|
| DE | 102005039751 | 3/2007 |
| DE | 102006024793 | 11/2007 |
| DE | 102006028611 | 12/2007 |

* cited by examiner

*Primary Examiner* — Ching Chang
(74) *Attorney, Agent, or Firm* — Volpe and Koening, P.C.

(57) ABSTRACT

A dual independent phasing system (DIPS) phaser assembly for coaxial camshafts having two axially stacked, thin phasing subassemblies which are each conventional vane-cell type phaser assemblies is provided. These phasers are preassembled together as a unit to make one DIPS phaser assembly. The rotor of the rear phaser is attached to the outer camshaft of the coaxial cam, and the rotor of the front phaser is attached to the inner camshaft. The radial force from the timing chain or belt is transmitted to the outer camshaft via a chain ring or pulley connected to the stator of the rear phaser. In order to provide for ease of mounting, the DIPS phaser assembly (including the front and rear phasers) is attached to the outer camshaft via mounting bolts which are passed through openings in the rotor of the front phaser in order to attach the rear phaser rotor to the outer camshaft. A central mounting bolt is used to connect the front phaser rotor to the inner camshaft. A radially stacked DIPS phaser assembly is also provided which offers further reduced axial space requirements.

9 Claims, 7 Drawing Sheets

DUAL INDEPENDENT PHASING SYSTEM TO INDEPENDENTLY PHASE THE INTAKE AND EXHAUST CAM LOBES OF A CONCENTRIC CAMSHAFT ARRANGEMENT

CROSS-REFERENCE TO RELATED APPLICATIONS

This application claims the benefit of U.S. Provisional Application No. 61/104,037, filed Oct. 9, 2008, which is incorporated herein by reference as if fully set forth.

BACKGROUND

The invention relates to a dual independent phasing system for independently adjusting the phase angle of both the intake and exhaust camshafts of a inner and outer camshafts of a concentric camshaft.

It is known to use two axially spaced apart camshaft phasers in connection with inner and outer shafts of a concentric camshaft assembly in order to separately adjust the timing of the inner and outer camshafts. This allows the timing of the intake and exhaust valves to be adjusted to obtain improved torque/power as well as improved emissions. Further, this arrangement provides additional benefits in engine idle stability and fuel economy.

Camshaft phasers that operate according to the vane-cell principle for single camshafts are known. These are described in publications by the assignee of the present invention, including U.S. Pat. No. 6,805,080, which is incorporated herein by reference as if fully set forth.

One known system for adjusting the control timing of a concentric camshaft assembly is described in DE 10 2005 039 751 A1. In this publication, a camshaft phaser located at the front of the engine is connected to an outer shaft of a co-axial camshaft arrangement and a second camshaft phaser located at the rear of the engine includes an outer housing that is connected to the outer camshaft and an inner rotor that is connected to the inner camshaft. This arrangement provides separate phasers which allows for easier control; however, it involves more difficulty in accessing the rear camshaft phaser as well as more complicated assembly and engine compartment space requirements.

DE 10 2006 024 793 A1 generically describes a dual phasing system for a concentric camshaft assembly which includes two camshaft phasers which are located at the front of an engine and are axially spaced adjacent to one another. The two camshaft phasers allow independent control of the outer and inner co-axial camshafts relative to the crankshaft in order to separately adjust the timing of the intake and exhaust valves of the internal combustion engine. The arrangement provides a specific spool valve control located within the inner camshaft for controlling the flow of hydraulic fluid to both the first and second camshaft phasers.

DE 10 2006 028 611, also discloses two camshaft phasers located axially adjacent to one another at the front of a concentric camshaft assembly of an internal combustion engine. The first camshaft phaser is connected to a front camshaft bearing arrangement which includes oil passages for delivering hydraulic fluid to and from the camshaft phaser for the outer camshaft. Hydraulic fluid for controlling the camshaft phaser connected to the inner camshaft is delivered via internal hydraulic fluid passageways located between the outer and inner camshafts and inside the inner camshaft which are supplied with hydraulic fluid through a separate camshaft mounting bearing arrangement.

These previously known dual independent phasing systems for concentric camshafts suffer from a number of drawbacks with respect to space requirements and ease of assembly to the front of a camshaft as a single assembly. Further, the prior known arrangements suffer from high external oil leakage due to the attachment method of the vanes to the covers of the camshaft phasers. Further, no system is provided for independently controlling the camshaft phasers for the inner and outer shafts so that they can be locked in base positions. Further, it would be beneficial to provide a dual independent phasing system which fits in roughly the same space within the engine assembly as a standard phaser so that additional space allocation with the engine compartment is not required.

SUMMARY

A dual independent phasing system for concentric camshaft applications which addresses the deficiencies in the known arrangements is provided.

In a first embodiment of the invention, the dual independent phasing system (DIPS) for coaxial camshafts comprises two axially stacked, thin phasing subassemblies which are each individually similar to a conventional vane-cell type phaser assembly of the assignee such as disclosed in U.S. Pat. No. 6,805,080. These phasers are assembled together as a unit to make one DIPS phaser assembly. The rotor of the rear phaser is attached to the outer camshaft of the coaxial cam, and the rotor of the front phaser is attached to the inner camshaft. The axial force from the timing chain or belt is transmitted to the outer camshaft via a chain ring connected to the stator of the rear phaser. In order to provide for ease of mounting, the DIPS phaser assembly (including the front and rear phasers) is attached to the outer camshaft via mounting bolts which are passed through openings in the rotor of the front phaser in order to attach the rotor of the rear phaser to the outer camshaft. A central mounting bolt is used to connect the rotor of the front phaser to the inner camshaft.

Preferably, in order to provide separate locking of the phase position of both the inner and outer camshafts, while maintaining the spacing requirements for the DIPS phaser assembly, radially oriented locking pins are located within the rotors of the front and rear phasers which are engagable in matching recesses in the respective stators of the front and rear phasers. Preferably the phaser associated with the intake camshaft is held in an advanced position and the phaser associated with the exhaust camshaft is held in a retarded position by the respective locking pins when the hydraulic fluid pressure drops below a certain level, such as during initial starting of the internal combustion engine. However, either the front or rear phaser can have a base (locked) position in either an advanced or retarded position, allowing combinations such as advance-advance, advance-retard, retard-advance, or retard-retard.

In a second embodiment of the invention, the DIPS phaser assembly includes a radially stacked phaser arrangement including an inner phaser and an outer phaser arranged concentrically over the inner phaser. The outer phaser includes an outer stator that is connected to the timing chain ring or timing belt pulley. The rotor of the outer camshaft phaser is connected to the outer camshaft and includes vanes which extend into spaces defined by inwardly directed projections of the outer stator, defining separate chambers on each side of the vanes. Extending radially inwardly from the rotor of the outer camshaft phaser is the stator of the inner camshaft phaser which includes radially inwardly directed projections. Vanes from the inner rotor of the inner camshaft phaser extend between the radially inwardly directed projections to define, in conjunction with the inwardly directed projections, separate chamber on each side of the inner rotor vanes. The rotor of the inner camshaft phaser is attached to the inner camshaft. In this arrangement, the outer camshaft can be advanced or retarded relative to the crankshaft by supplying pressurized hydraulic fluid to the first or second sets of chambers of the outer camshaft phaser causing vanes in the chambers to either advance or retard the outer camshaft phaser rotor and thereby adjust the timing position of the outer camshaft. The phase position of the inner camshaft is similarly adjusted by providing pressurized hydraulic fluid to the first or second sets of chambers of the inner camshaft phaser to rotate the vanes which separate the chambers in order to adjust the position of the inner camshaft relative to the position of the outer camshaft. The engine control module for his embodiment is programmed to compensate for the compound movement of the inner rotor created by movement of the outer rotor, such that if the outer phaser is to be advanced 10° while maintaining the position of the inner phaser, the engine controller would need to advance the outer phaser the desired 10° while retarding the inner phaser 10° to keep it statically timed.

Further aspects of the invention, which can be used alone or in combination, are described in detail below.

BRIEF DESCRIPTION OF THE DRAWINGS

The foregoing Summary and the following detailed description will be better understood when read in conjunction with the appended drawings, which illustrate preferred embodiments of the invention. In the drawings.

DETAILED DESCRIPTION OF THE PREFERRED EMBODIMENTS

Figure 1:
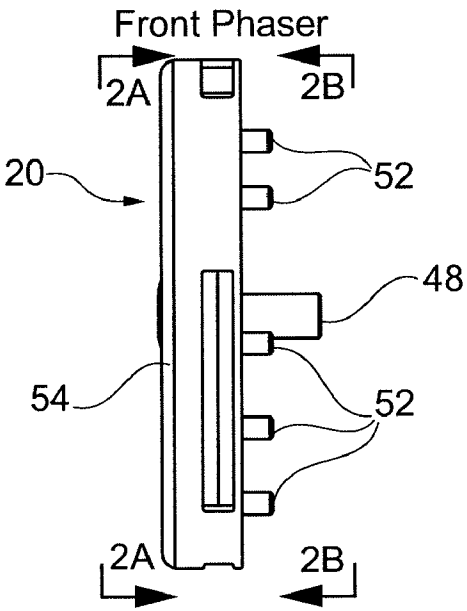
FIG. 1 is a side view of a dual independent phasing system (DIPS) phaser assembly in accordance with the first preferred embodiment of the invention.
Figure 2:
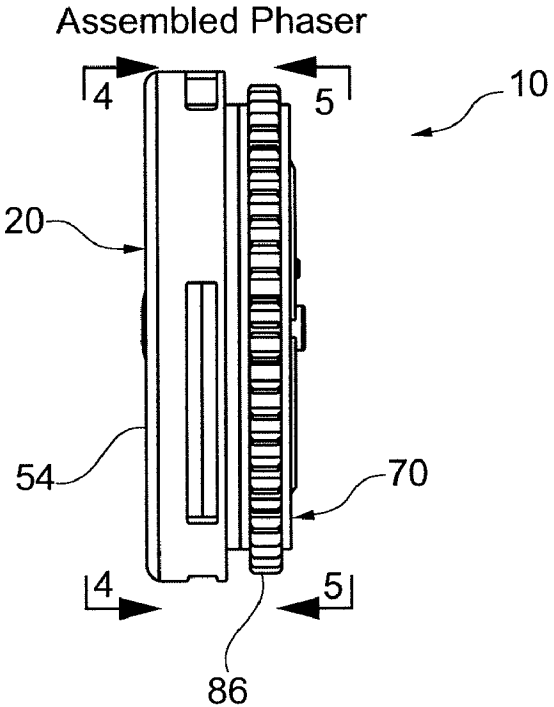
FIG. 2 is a side elevational view of a front phaser prior to assembly with the rear phaser of the DIPS phaser assembly of FIG. 1.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b and c represent the items being listed) means any single one of the items a, b or c, or combinations thereof. The terminology includes the words specifically noted above, derivatives thereof and words of similar import.

Figure 6:
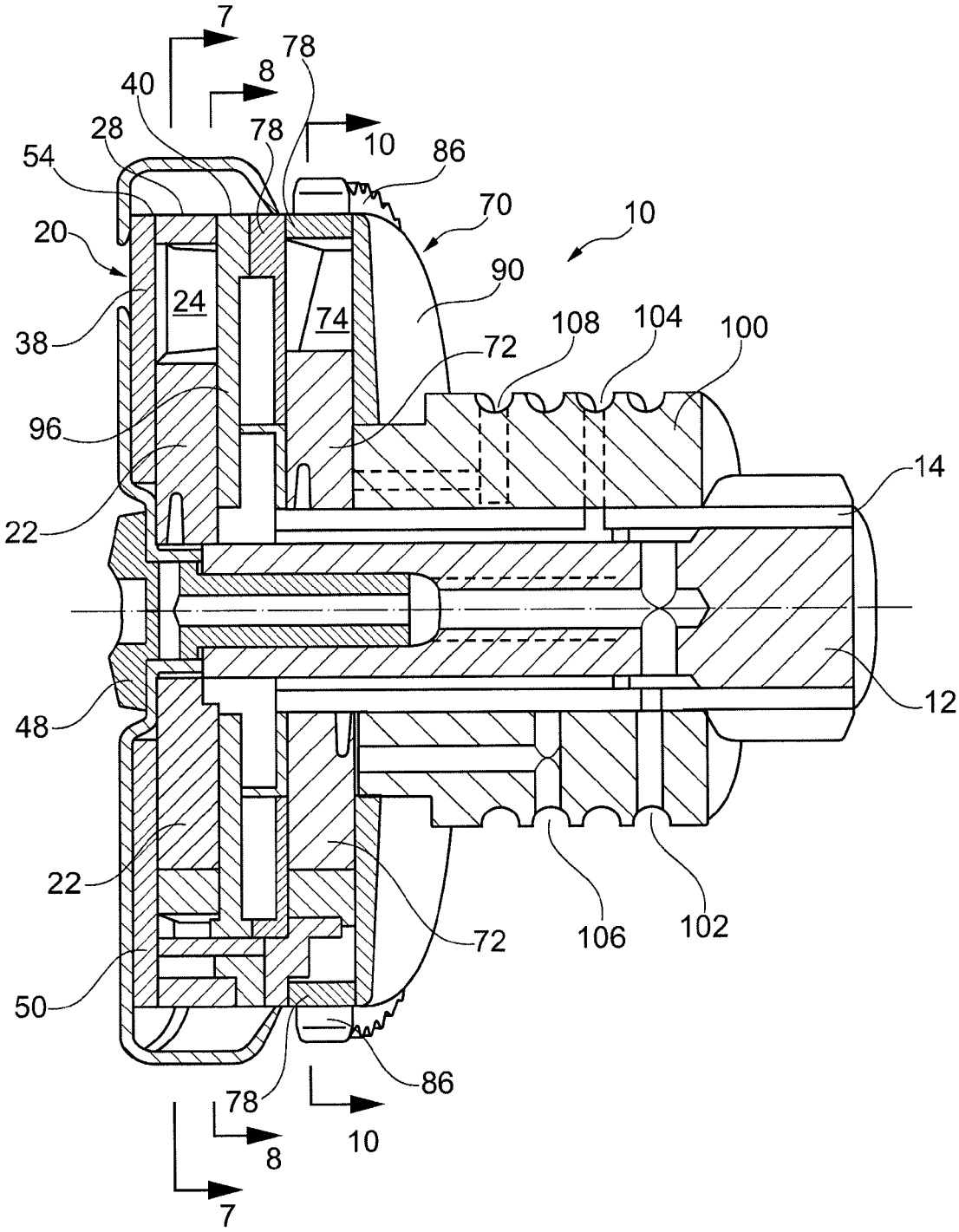
FIG. 6 is an isometric cross-sectional view taken along line 6-6 in FIG. 4.

Referring now to FIGS. 1 and 6, a DIPS camshaft phasing system having a preassembled DIPS phaser assembly 10 in accordance with the present invention is shown. The DIPS camshaft phaser assembly 10 is used in conjunction with a concentric camshaft arrangement for transferring torque from the crankshaft of an internal combustion engine to both inner and outer camshafts 12, 14, respectively (shown in FIG. 6), in order to control the intake and exhaust valves of the internal combustion engine. As concentric camshaft systems are known, the inner and outer concentric camshafts 12, 14 are not described in further detail and would be understood by a person of ordinary skill in the art. Activation of intake and exhaust gas exchange valves using camshafts and associated rocker arms, finger levers, cup tappets and other types of actuators are also known, and are therefore not described herein.

Figure 3:
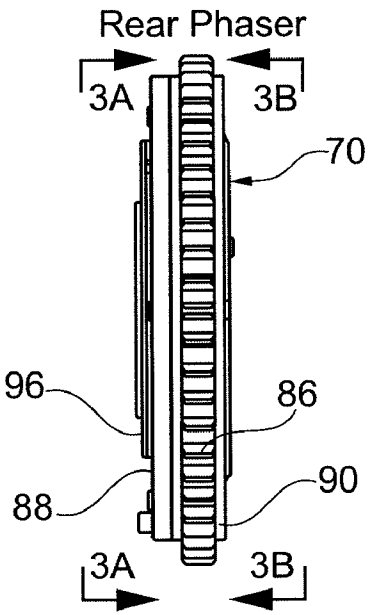
FIG. 3 is a side elevational view of the rear phaser of FIG. 1 prior to assembly to form the DIPS phaser assembly.
Figures 2A, 3A, 4:
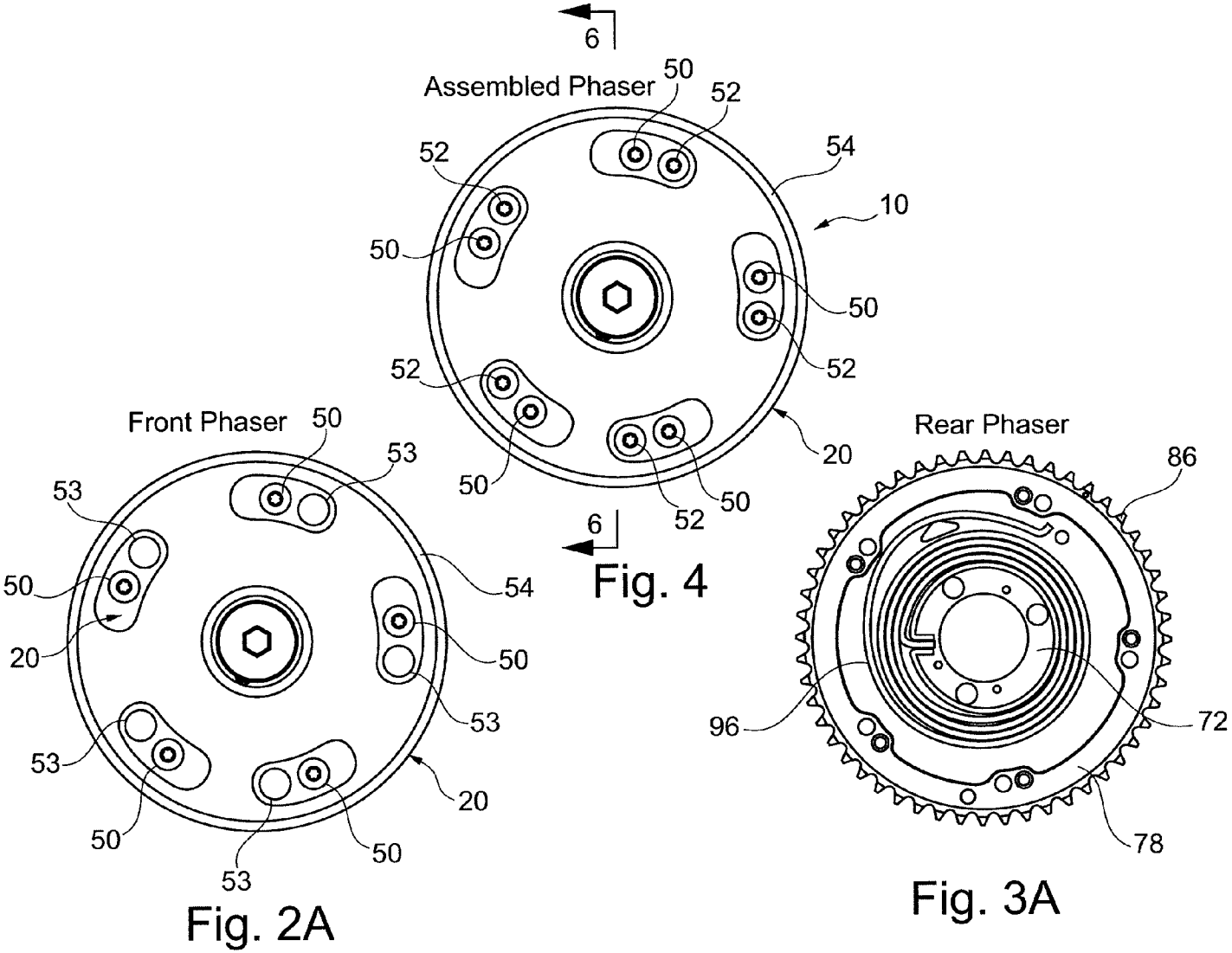
FIG. 2A is a front elevational view of the front phaser taken along line 2A-2A in FIG. 2.
FIG. 3A is a front elevational view of the rear phaser taken along line 3A-3A in FIG. 3.
FIG. 4 is a front elevational view of the DIPS phaser assembly of FIG. 1 taken along lines 4-4 in FIG. 1.
Figure 5:
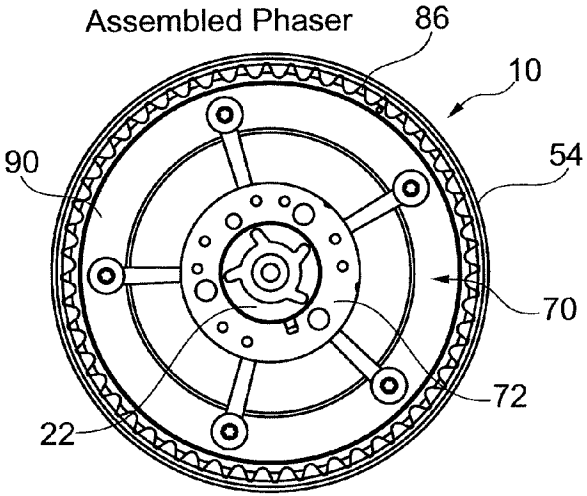
FIG. 5 is a rear elevational view of the DIPS phaser assembly of FIG. 1 taken along lines 5-5 in FIG. 1.
Figure 3B:
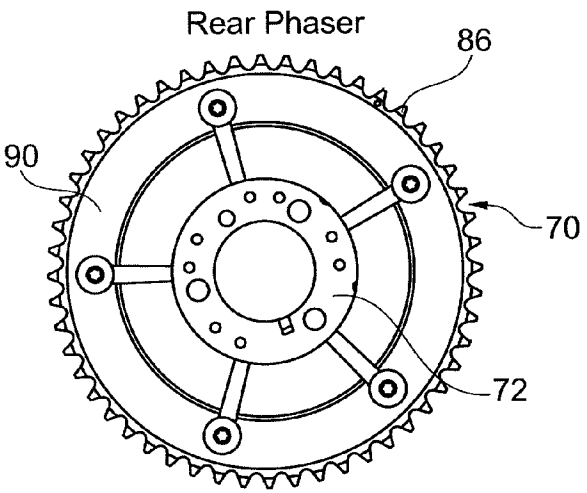
FIG. 3B is a rear elevational view of the rear phaser taken along line 3B-3B in FIG. 3.
Figure 2B:
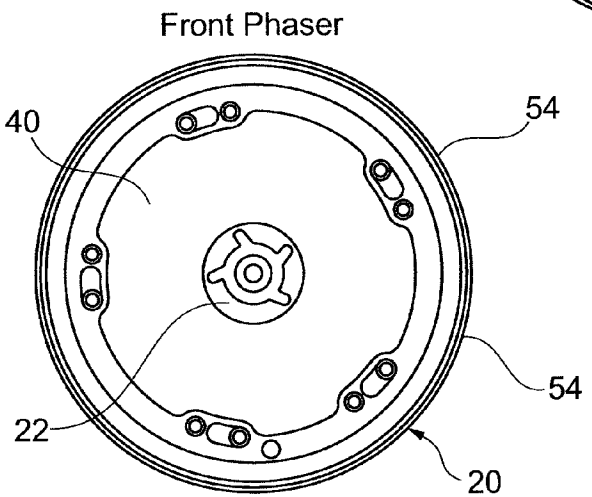
FIG. 2B is a rear elevational view of the front phaser taken along line 2B-2B in FIG. 2.

The DIPS camshaft phaser 10 is provided as a unitized assembly which can be connected to the inner and outer camshafts 12, 14 when the engine is being assembled. The unitized DIPS phaser assembly 10 includes a front phaser 20 and a rear phaser 70, which can be separately assembled and then joined together. The front phaser 20 is shown in detail in FIGS. 2, 2A, 2B and 6-9. The rear phaser 70 is shown in detail in FIGS. 3A, 3B, 6 and 10-11. FIGS. 4 and 5 show front and rear views respectively of the assembled DIPS phaser assembly 10.

Referring to FIGS. 2, 2A, 2B and 6-9, the front phaser 20 is a camshaft phaser which operates in accordance with the vane-cell principle and is connected to the inner camshaft 12. The front phaser 20 includes a rotor 22 having vanes 24 extending therefrom into spaces formed between inwardly directed projections 30 of the stator 28. The vanes 24 are preferably spring biased outwardly to provide a tight seal against the mating surface of the stator 28. The vanes 24 divide the spaces between the inwardly directed projections 30 of the stator 28 into first chambers 32 and second chambers 34. A front cover 38 and a rear cover 40 are located on both sides of the rotor 22 and stator 28 and are fastened to the stator 28 in order to create a sub-assembly of the front phaser 20, and to define the front and rear walls of the chambers 32, 34.

By applying pressurized hydraulic fluid in either the first chambers 32 or the second chambers 34 or both the first and second chambers 32 and 34, the rotor 22 and the inner camshaft 12 connected thereto can be rotated into an advanced or retarded position relative to the stator 28, or can be hydraulically locked in a generally fixed position relative to the stator 28.

The stator 28 is fastened via bolts 52 which extend through openings 53 to the stator 78 of the rear phaser 70 which is connected to the timing chain gear 86 or alternately a timing belt pulley.

A hollow attachment bolt 48, shown in FIG. 6, is used to connect the rotor 22 of the front phaser assembly to the inner camshaft 12. As shown in detail in FIGS. 6-9, pressurized hydraulic fluid passageways 102, 104 are provided in a bearing surface 100 on the outer camshaft 14 for supplying pressurized hydraulic fluid to the first and second chambers 32, 34 of the front phaser 20. The pressurized hydraulic fluid passages designated as a whole as 102 provide pressurized hydraulic fluid to the chambers 34 in order to rotate the rotor 22 in a direction to retard the timing of the inner camshaft 12. The pressurized hydraulic fluid passages designated as a whole as 104, provide pressurized hydraulic fluid to the first chambers 32 in order to rotate the rotor 22 in a direction to advance the inner camshaft 12 timing. The pressurized hydraulic fluid is provided to the outer cam bearing surface 100 shown in FIG. 6 through a hydraulic valving system (not shown) so that either or both hydraulic fluid passages 102 and 104 can be connected to a source of pressurized hydraulic fluid or a drain in order to selectively advance or retard the timing of the inner camshaft (12), or hydraulically lock the position of the rotor 22 with the stator 28.

As shown in FIG. 2A, the front and rear covers 38, 40 of the front phaser 20 are connected together with the stator 28 via bolts 50. Clearance holes are provided through the outer cover 54 as well as through the front and rear cover plates 38, 40 and the stator 28 for assembly bolts for joining the front phaser 20 to the rear phaser 70.

Figure 8:
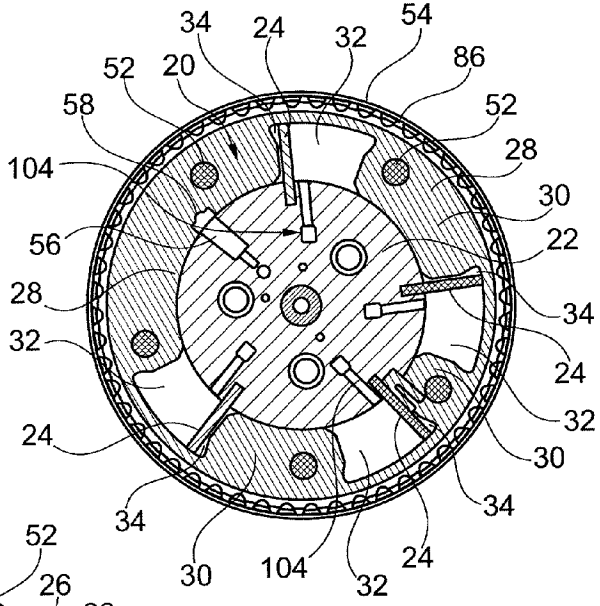
FIG. 8 is a cross-sectional view through the DIPS phaser assembly taken along line 8-8 in FIG. 6.
Figure 9:
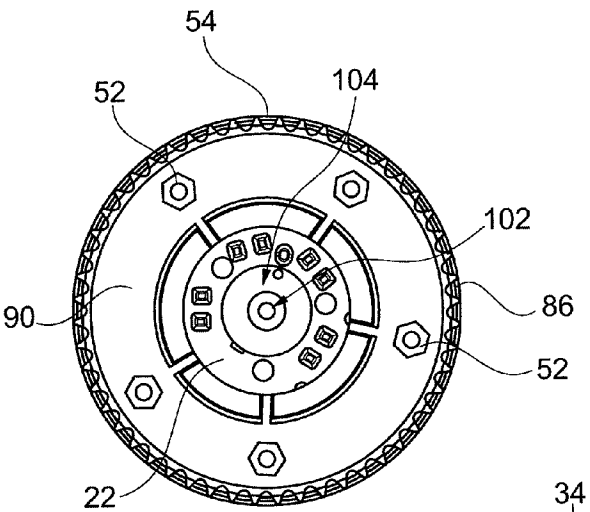
FIG. 9 is a rear elevational view of the front phaser illustrating the oil passages in conjunction with FIGS. 7 and 8.

Referring to FIGS. 8 and 9, a radially extending locking pin 56 is provided in the rotor 22 which can engage in a corresponding recess 58 in the stator 28 that can be used to hold the stator 28 and rotor 22 in a fixed base position relative to one another. This is required during startup of the engine and at other times when the pressure of the pressurized hydraulic fluid is insufficient to provide for stable adjustment or holding of the rotor 22 relative to the stator 28. The radial locking pin 56 is released preferably via pressurized hydraulic fluid being supplied to the recess 58 in order to depress the locking pin 56 inwardly into the rotor 22.

In the first preferred embodiment, the front phaser 20 is used to control the inner camshaft 12 which has cam lobes that control the intake valves, and thus the preferred base position for engaging the axial locking pin 56 is in the advanced position.

Referring now to FIGS. 3, 3A, 3B, 6 and 10-11, the rear phaser 70 will be explained in further detail. The rear phaser 70 also operates according to the vane-cell principal, and includes a rotor 72 having a plurality of vanes 74 extending outwardly therefrom. The vanes 74 are preferably spring biased and extend into spaces located between inwardly directly projections 80 on a stator 78. The vanes 74 divide the spaces into first and second chambers 82, 84, respectively, which are located on either side of each vane 74. Front and rear covers 88, 90 from the front and rear walls of the chambers 82, 84 and allow the rear phaser 70 to be separately preassembled.

The stator 78 is preferably connected to a timing chain gear 86, or alternatively to a timing belt pulley, that is connected via a timing chain or belt to the crankshaft of an internal combustion engine in order to transfer torque from the crankshaft to the inner and outer camshafts 12, 14 of the concentric camshaft. The timing gear 86 or pulley can be connected directly to the stator 78, or to the front or rear covers 88, 90, or can be formed integrally with any of these components.

Third and fourth pressurized hydraulic fluid passages 106, 108 extend from the outer cam bearing surface 100. The third passages, designated as a whole as 106, are connected to the second chambers 84 such that pressurized hydraulic fluid introduced into these chambers 84 cause the rotor 72 to rotate in a direction to retard the timing of the outer camshaft 14. Pressurized fluid introduced through the fourth hydraulic fluid passages, designed as a whole as 108, which are connected to the first chambers 82 cause the rotor 72 to rotate in an advancing direction relative to the stator 78. Applying pressurized hydraulic fluid through both the third and fourth passages 106, 108 causes both the first and second chambers 82, 84 of the rear phaser 70 to be pressurized, hydraulically locking the rotor 72 into a fixed position relative to the stator 78.

In the preferred embodiment, a hydraulic control valve is utilized to connect either or both of the third and fourth pressurized hydraulic fluid passages 106, 108 to either a source of pressurized hydraulic fluid or a drain so that pressurized hydraulic fluid can be selectively supplied to either or both of the first and second chambers 82, 84 of the rear phasers 70.

Figure 10:
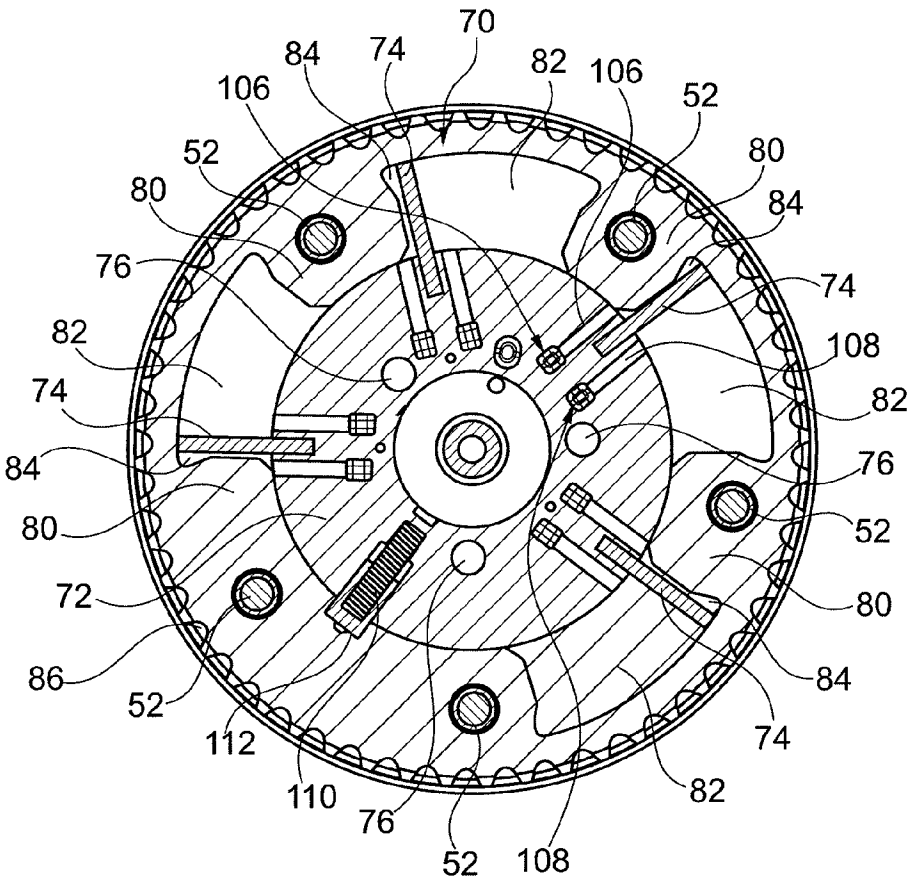
FIG. 10 is a cross-sectional view of the DIPS phaser assembly taken along line 10-10 in FIG. 6.
Figure 11:
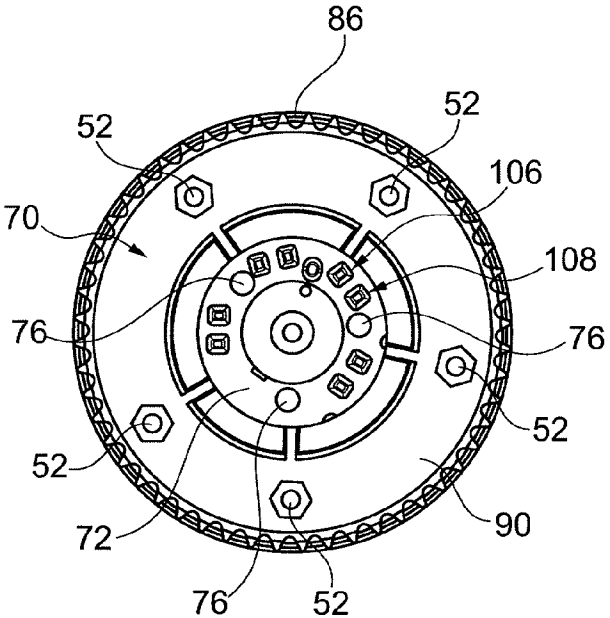
FIG. 11 is a rear elevational view of the rear phaser which, in conjunction with FIG. 10, shows the oil passages for advancing and retarding the rear phaser.

As shown in FIGS. 10 and 11, preferably holes 76 are provided in the rotor 72 of the rear phaser 70 for bolts that can be used to connect the rear phaser rotor 72 to the outer camshaft 14.

Figure 7:
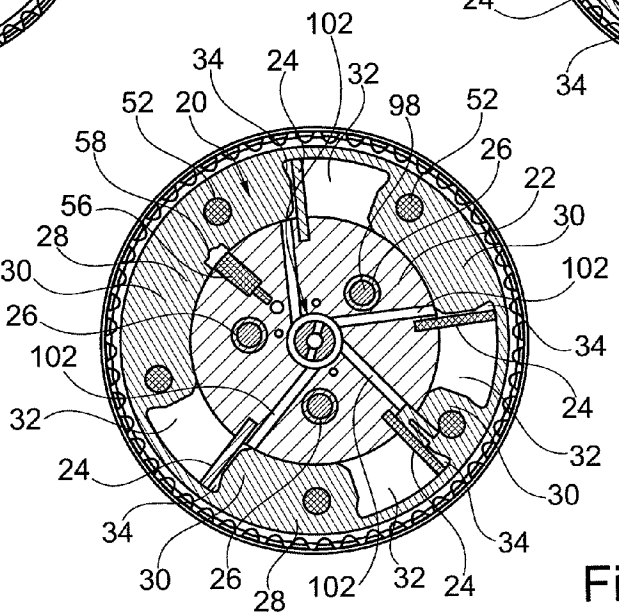
FIG. 7 is a cross-sectional view through the DIPS phaser assembly taken along line 7-7 in FIG. 6.

In order to allow assembly of the unitized DIPS phaser assembly 10 to the inner and outer camshaft 12, 14, clearance holes 26 are provided through the inner rotor 22 shown in FIG. 7, so that bolts 98, also shown in FIG. 7, can be installed through the front phaser 20 and into the rotor 72 of the rear phaser 70 in order to form the connection between the rear rotor 72 and the outer camshaft 14. As previously noted, the front phaser rotor 22 can be connected to the inner camshaft 12 via a central attachment bolt 48, which is preferably provided with portions of the first oil passages 102 as shown in FIG. 6.

Referring again to FIG. 10, the rear phaser 70 includes a radial locking pin 110 located in the rotor 72 which engages in a recess 112 in the rear phaser stator 78 in order to lock the rotor 72 into a fixed, base position relative to the stator 78. This is important during startups when there is insufficient oil pressure to provide reliable adjustment of the rotor 72 relative to the stator 78. The radial locking pin 110 is released when sufficient hydraulic fluid pressure is supplied to the recess 112 in order to press the spring biased locking pin 110 back into the rotor 72.

Referring now to FIG. 3A, a helical equalizing spring 96 is connected between the rear phaser stator 78 and rotor 72. This spring 96 is used to equalize the force required to advance the rear phaser rotor 72 relative to the stator 78. Depending on the particular design, an equalizing spring could be provided for the front phaser 20, both the front phaser 20 and the rear phaser 70, or neither phaser.

In use, the DIPS phaser assembly 10 allows easier assembly of a DIPS phaser assembly for concentric camshafts that allows timing adjustments to both the inner and outer camshafts 12, 14 due to the fact that it can be preassembled and then attached to the concentric camshaft during assembly of the engine. This reduces the number of parts and the time required during assembly of the engine and allows the DIPS phaser assembly 10 to be completely assembled offsite, preferably at a separate manufacturing facility. Additionally, the arrangement of the timing chain gear 86 or alternatively the timing belt pulley on or connected to the stator 78 allow direct axial transfer of loads via the supporting surfaces formed by the inwardly directed projections 80 of the stator 78 against the rotor 72, which rests directly on the outer camshaft 14. This prevents any bending loads from being introduced into the inner camshaft 12 as the axial loads are directly transferred to the outer camshaft 14. This arrangement further provides a reduced axial length in comparison to other known arrangements due to the radial locking pin arrangement for locking the inner and outer camshafts 12, 14 into a base position. This advantageously allows the DIPS phaser assembly 10 to fit roughly into the same engine packaging space as a standard camshaft phasing system.

Figure 13:
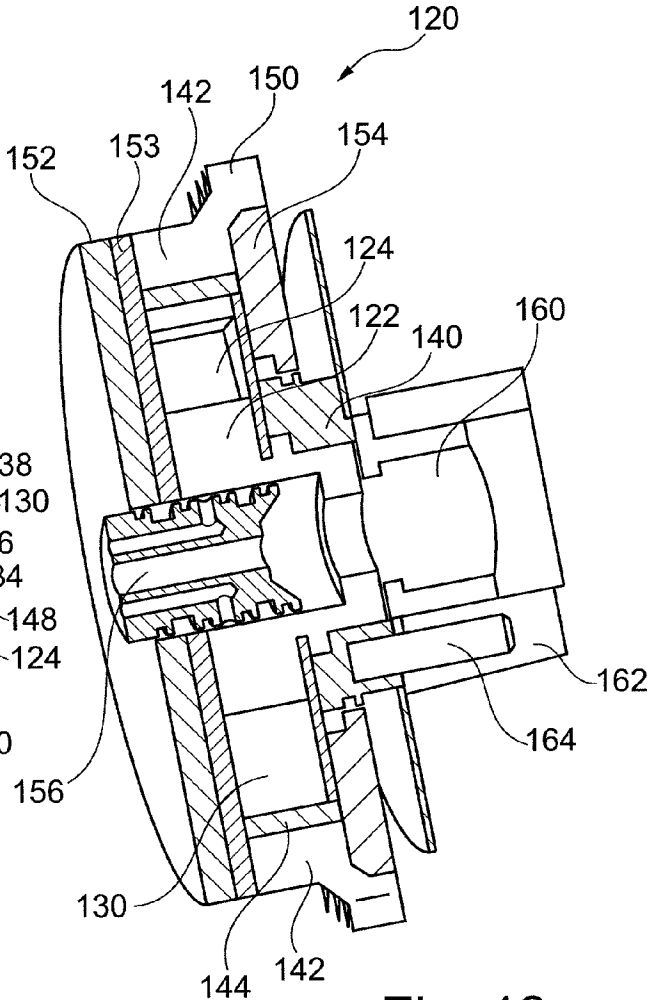
FIG. 13 is a cross-sectional view taken along lines 13-13 in FIG. 12.
Figure 12:
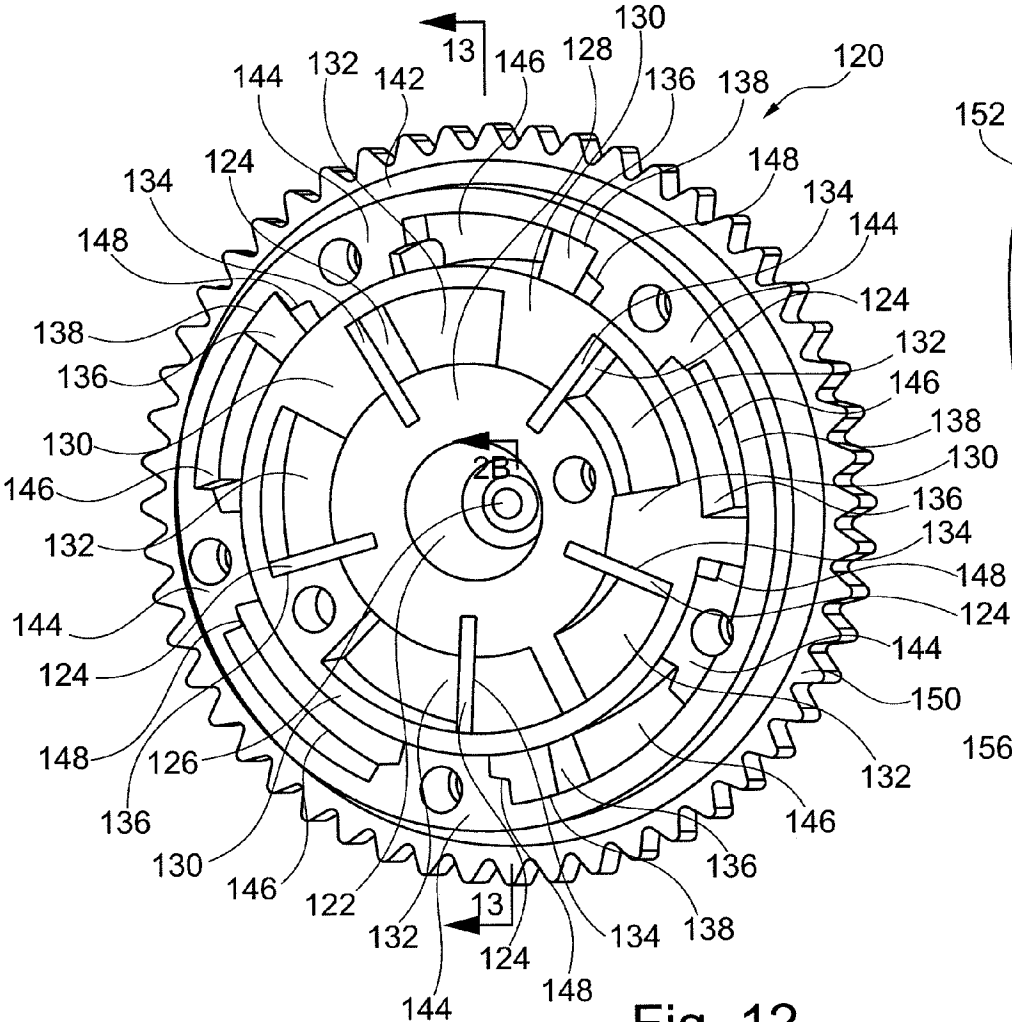
FIG. 12 is a front prospective view of the second embodiment of the DIPS phaser assembly in accordance with the present invention.

Referring now to FIGS. 12 and 13, the second embodiment of the DIPS phaser assembly 120 is shown. The DIPS phaser assembly 120 includes two radially stacked phasers for separately phasing the inner and outer camshafts 160, 162 of a concentric camshaft arrangement.

The radially stacked DIPS phaser assembly 120 includes an inner rotor 122 that is connected to the inner camshaft 162. The inner rotor 122 includes outwardly biased, radially extending vanes 124 which extend into spaces formed between inwardly directed projections 130 of an inner stator/outer rotor ring 128. The vanes 124 divide the spaces into first and second chambers 132, 134, respectively. The inner stator/outer rotor ring 128 further includes outwardly directed vanes 136 having radially, outwardly directed seals 138 on the ends thereof. These vanes 136 of the inner stator/outer rotor ring 138 extend into spaces located between inwardly directed projections 144 of an outer stator 142. These outer vanes 136 divide the spaces into third and fourth chambers 146, 148. A timing chain gear 150, or alternatively, a timing belt pulley, is fixed to the outer stator 142. The first, second, third and fourth chambers 132, 134, 146, 148 are bounded on the front and rear sides via a front cover 152 and a rear cover 154. An oil passage plate 153 is located between the front cover 152 and the inner rotor 122, inner stator/outer rotor ring 128 and outer stator 142, and is used in order to provide pressurized hydraulic fluid passages that extend to the third and fourth chambers 146, 148. Pressurized hydraulic fluid passages to the first and second chambers 132, 134 are provided via a central hydraulic fluid distributor 156 through openings (not shown) in the inner rotor 122 in a known manner. The inner rotor 122 is preferably connected to the inner camshaft 162 in a known manner by a central bolt.

The inner stator/outer rotor ring 128 is connected via and adaptor 140 to the outer camshaft 162. As shown in FIG. 13, one or more pins 164 can be utilized to ensure a locked rotational connection between the connection part 140 and the outer camshaft 162.

The radial loads from the timing chain or belt are carried via the bearing surfaces of the outer stator 142 to the inner stator/outer rotor ring 128, and into the outer camshaft 162.

In operation, the DIPS radially stacked phaser assembly 120 is operated in a similar manner to the first embodiment of the DIPS axially stacked phaser assembly 10. The position of the outer camshaft 162 relative to the timing chain gear 150 or alternatively the timing belt pulley which is in a fixed phase relationship with the crankshaft via a traction element, such as a timing chain or belt, is adjusted by supplying hydraulic fluid to either or both of the third and fourth chambers 146, 148 in order to cause the inner stator/outer rotor ring 128 to rotate relative to the outer stator 142. By supplying pressurized hydraulic fluid to either of the third and fourth chambers 146, 148, the timing of the outer camshaft 162 can be either advanced or retarded, and supplying pressurized hydraulic fluid to both the third and fourth chambers 146, 148 locks the outer rotor 128 in position relative to the outer stator 142. Preferably, a base position locking pin arrangement is provided in order to hold the inner stator/outer rotor ring 128 in a fixed position relative to the outer stator 142 during periods of low hydraulic fluid pressure, such as during the startup.

In order to adjust the timing of the inner camshaft 160, pressurized hydraulic fluid is provided to either of the first and second chambers 132, 134 in order to rotate the inner rotor 122 relative to the inner stator/outer ring 128. Supplying pressurized hydraulic fluid to both the first and second chambers 132. 134 locks the inner rotor 122 in position relative to the inner stator 128. A second locking mechanism is preferably also provided for locking the inner rotor 122 to the inner stator/outer rotor ring 128 in order to hold the inner rotor in a base position during engine startup or at times of insufficient pressurized hydraulic fluid being delivered to either or both of the first and second chambers 132, 134.

Due to the radially stacked arrangement of the phasers for the inner and outer camshafts 160, 162, a more complex control system is required by the engine control module (not shown). For example, in order to advance the outer phaser while maintaining the position of the inner phaser, the engine controller is required to advance the outer phaser to the desired angle, for example 10° advanced, while retarding the inner phaser an equal amount, in this example of 10° in the retarded direction, in order to keep the inner phaser statically timed.

The radially stacked DIPS phaser assembly 120 provides all of the advantages noted above in connection with the first preferred embodiment with respect to the ability to preassemble a unitized DIPS phaser separate and apart from an engine and allow for easy attachment to the engine during assembly. This also allows for easier maintenance of the DIPS phaser assembly 120 as it can be removed and replaced as a unitized assembly in a straight forward manner. Additionally, the radially stacked DIPS phaser 120 provides further advantages in reduced axial space requirements in comparison to the known systems.

What is claimed is:

1. A dual independent phasing system (DIPS) phaser assembly for coaxial camshafts comprising:

first and second phaser subassemblies, each including a rotor with outwardly directed vanes, a stator with inwardly directed projections, each of the vanes extending between a pair of the inwardly directed projections to define pressurized hydraulic fluid chambers for advancing or retarding the rotor relative to the stator, and front and rear covers defining the front and rear walls of the chambers, the rotors being adapted for connection to an inner camshaft and an outer camshaft, respectively;

a timing gear or pulley connected to the stator of one of the phaser subassemblies, the timing gear or pulley being arranged to transmit radial loads into the outer camshaft;

the first and second phaser subassemblies are preassembled together as a unit;

the first and second phaser assemblies are axially arranged adjacent to each other, and the stators of the first and second phaser subassemblies are connected together; and a helical equalizing spring is located between the first and second phaser assemblies and is connected between the stator and the rotor of the second phaser.

2. The DIPS phaser assembly of claim 1, wherein the first phaser subassembly is in front and is adapted for connection to the inner camshaft, and the second phaser subassembly is rearward and is adapted for connection to the outer camshaft.

3. The DIPS phaser assembly of claim 2, wherein each of the phaser subassemblies further comprises a radially arranged locking pin for locking the rotor in a fixed, base position relative to the stator.

4. The DIPS phaser assembly of claim 3, wherein the rotor of the front phaser includes clearance openings through which mounting bolts for connection of the rotor of the second phaser subassembly to the outer camshaft pass.

5. The DIPS phaser assembly of claim 3, further comprising a central mounting bolt to connect the front phaser rotor to the inner camshaft.

6. A dual independent phasing system (DIPS) phaser assembly for coaxial camshafts comprising:

first and second phaser subassemblies, each including a rotor with outwardly directed vanes, a stator with inwardly directed projections, each of the vanes extending between a pair of the inwardly directed projections to define pressurized hydraulic fluid chambers for advancing or retarding the rotor relative to the stator, and front and rear covers defining the front and rear walls of the chambers, the rotors being adapted for connection to an inner camshaft and an outer camshaft, respectively;

a timing gear or pulley connected to the stator of one of the phaser subassemblies, the timing gear or pulley being arranged to transmit radial loads into the outer camshaft;

the first and second phaser subassemblies are preassembled together as a unit, and the second phaser subassembly is located radially around the first phaser subassembly, and the vanes of the rotor for the second phaser extend outwardly from the stator of the first phaser subassembly, forming an inner stator/outer rotor ring.

7. The DIPS phaser assembly of claim 6, further comprising an oil passage plate located between the front cover and the inner rotor.

8. The DIPS phaser assembly of claim 7, further comprising a central hydraulic fluid distributor that provides a pressurized hydraulic fluid path to oil passages in the oil passage plate for the pressurized hydraulic fluid chambers of the second phaser.

9. The DIPS phaser assembly of claim 6, wherein the inner stator/outer rotor ring is connectable via an adaptor to the outer camshaft.

* * * * *